US009562660B2

(12) United States Patent
Erdl et al.

(10) Patent No.: US 9,562,660 B2
(45) Date of Patent: Feb. 7, 2017

(54) LIGHTING DEVICE FOR A MOTOR VEHICLE

(71) Applicant: Bayerische Motoren Werke Aktiengesellschaft, Munich (DE)

(72) Inventors: Helmut Erdl, Flintsbach (DE); Abdelmalek Hanafi, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 336 days.

(21) Appl. No.: 14/256,298

(22) Filed: Apr. 18, 2014

(65) Prior Publication Data

US 2014/0226352 A1 Aug. 14, 2014

Related U.S. Application Data

(63) Continuation of application No. PCT/EP2012/070559, filed on Oct. 17, 2012.

(30) Foreign Application Priority Data

Oct. 28, 2011 (DE) ..... 10 2011 085 378

(51) Int. Cl.
*F21S 8/10* (2006.01)

(52) U.S. Cl.
CPC ..... *F21S 48/1145* (2013.01); *F21S 48/115* (2013.01); *F21S 48/1154* (2013.01); *F21S 48/214* (2013.01); *F21S 48/215* (2013.01)

(58) Field of Classification Search
CPC ... F21S 48/1145; F21S 48/115; F21S 48/1154; F21S 48/214; F21S 48/512
USPC ..... 362/543–545
See application file for complete search history.

(56) References Cited

U.S. PATENT DOCUMENTS

| | | | | |
|---|---|---|---|---|
| 6,491,420 | B1 | 12/2002 | Scifres | |
| 6,736,524 | B2 | 5/2004 | Albou | |
| 7,165,871 | B2 | 1/2007 | Takeda et al. | |
| 2005/0105301 | A1 | 5/2005 | Takeda et al. | |
| 2011/0148280 | A1 | 6/2011 | Kishimoto et al. | |
| 2011/0194302 | A1 | 8/2011 | Kishimoto et al. | |
| 2011/0249460 | A1 | 10/2011 | Kushimoto | |
| 2012/0025962 | A1* | 2/2012 | Toll | B60Q 1/50 340/431 |

FOREIGN PATENT DOCUMENTS

| | | |
|---|---|---|
| CN | 102121651 A | 7/2011 |
| DE | 1 755 960 | 7/1968 |
| DE | 698 05 626 T2 | 9/2002 |

(Continued)

OTHER PUBLICATIONS

Chinese Office Action dated Jun. 15, 2015 (Eight (8) pages).

(Continued)

*Primary Examiner* — Laura Tso
(74) *Attorney, Agent, or Firm* — Crowell & Moring LLP

(57) ABSTRACT

A lighting device for a motor vehicle includes one or more lighting units, herein during operation a respective lighting unit generates a point-shaped light source via laser light. In addition, optical device is configured and arranged with respect to the lighting unit or lighting units in such a way that a predetermined distribution of light composed of the light of the point-shaped light source is generated after it passes through the optical device.

21 Claims, 1 Drawing Sheet

(56) References Cited

FOREIGN PATENT DOCUMENTS

| | | | |
|---|---|---|---|
| DE | 101 57 314 | A1 | 6/2003 |
| EP | 1 369 639 | A1 | 12/2003 |
| WO | WO 2010/020930 | A1 | 2/2010 |
| WO | WO 2010/075629 | A1 | 7/2010 |
| WO | WO 2010/116305 | A1 | 10/2010 |

OTHER PUBLICATIONS

German Search Report dated Apr. 26, 2012 with English translation (ten (10) pages).
International Search Report dated Nov. 23, 2012 with English translation (seven (7) pages).

* cited by examiner

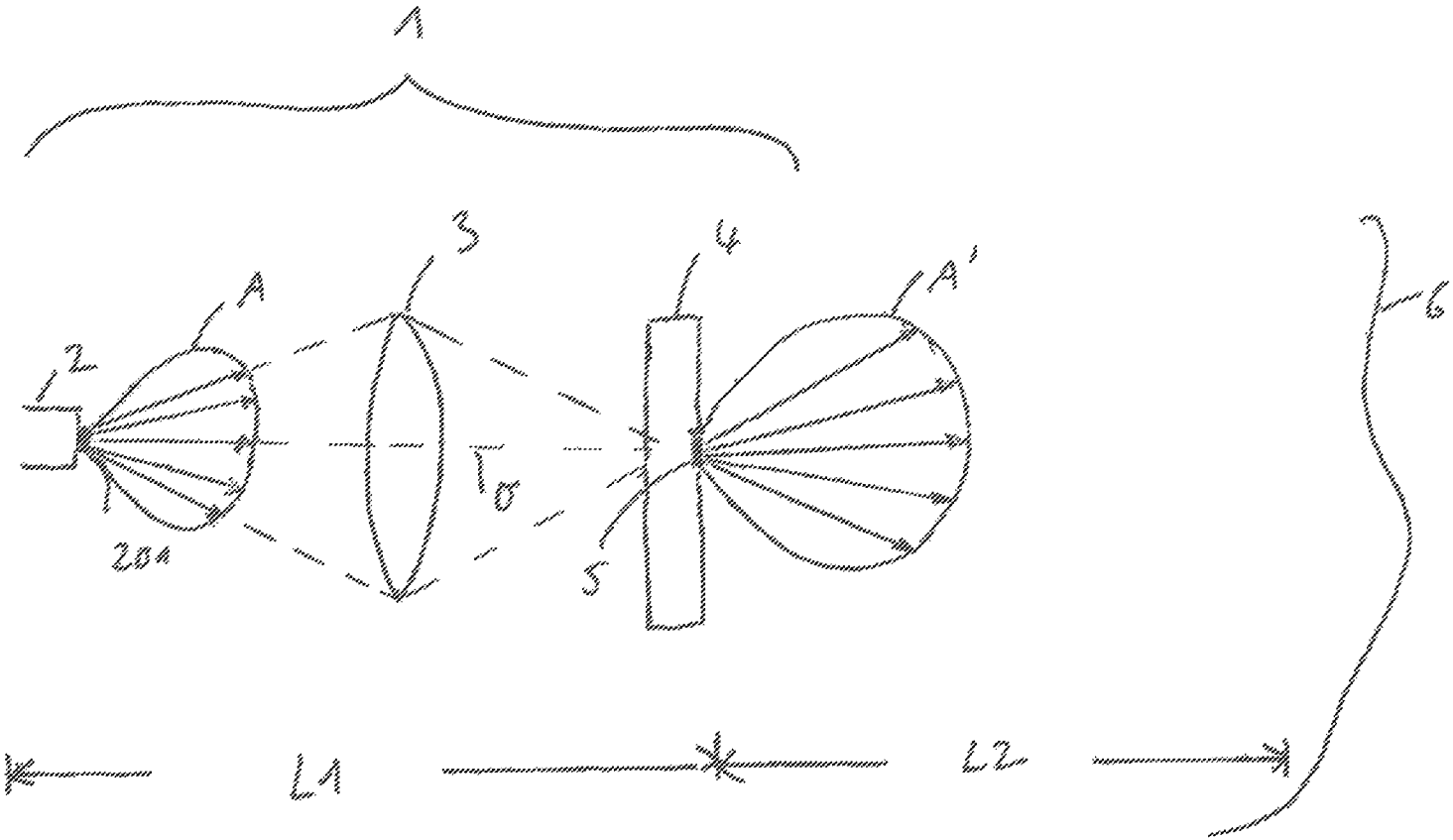
1
2
A
2α
5
L0
4
A'
5
L1
L2
6

LIGHTING DEVICE FOR A MOTOR VEHICLE

CROSS REFERENCE TO RELATED APPLICATIONS

This application is a continuation of PCT International Application No. PCT/EP2012/070559, filed Oct. 17, 2012, which claims priority under 35 U.S.C. §119 from German Patent Application No. 10 2011 085 378.2, filed Oct. 28, 2011, the entire disclosures of which are herein expressly incorporated by reference.

BACKGROUND AND SUMMARY OF THE INVENTION

The invention relates to a lighting device for a motor vehicle.

Nowadays, LED lighting devices are increasingly used in motor vehicles, by which suitable light distributions are generated for signal lights or headlights of the vehicle. Since the luminance for LEDs is relatively low, large installation spaces are required for the lighting device, particularly for generating light for high ranges. Lighting devices based on LEDs are not efficient in smaller installation spaces. In addition, it is difficult to generate a high-precision arbitrarily shaped light distribution by the use of LEDs.

It is an object of the invention to create a lighting device for a motor vehicle by which highly precise or efficient light distributions can be generated in small installation spaces.

This and other objects are achieved by a lighting device according to the invention for a motor vehicle, particularly for a passenger car and, if necessary, also for a truck. The lighting device includes one or more lighting units, a respective lighting unit being further developed such that, when it is operated by a laser light, it generates a punctiform light source. In this case, a punctiform light source is a light source having a small light-emitting surface and a large light flux, i.e. high luminance, which, with respect to the dimensions of the lighting device, in good approximation, may be assumed to be punctiform in that all rays of the light source originate from a single point.

The lighting device according to the invention further includes an optical device, which is further developed and arranged with respect to the lighting unit or lighting units such that a specified light distribution from the light of the punctiform light source will be generated after passing through the optical device. In this case, the optical device may, if required, be constructed of several partial units which, each separately, are assigned to a lighting unit. Likewise, there is the possibility that the optical device represents a continuous unit, on which the light of all lighting units is incident.

The lighting device according to the invention has the advantage that a punctiform light source with a very high luminance can be generated in a simple manner by way of laser light, so that the corresponding dimensions of the lighting device, particularly of the optical device for generating the specified light distribution, can be selected to be compact. In a particularly preferred embodiment, the maximal dimension of the punctiform light source in a top view, i.e. in the main radiation direction with the greatest intensity of the light source, amounts to 500 μm or less, preferably 100 μm or less, and particularly preferably 20 μm or less. Furthermore, in the top view, the punctiform light source preferably has a emitting surface of 0.5 $mm^2$ or less, particularly of 0.01 $mm^2$ or less, and particularly preferably of 0.0002 or less. The punctiform light source includes particularly an emitting cornered surface whose edges have a length of 500 μm or less and preferably 20 μm or less. The punctiform light source with the above-described dimensions is preferably further developed such that it generates a light flux of 100 lm or more and particularly of 200 lm or more and/or has a radiant power of 1 Watt or more and/or a luminance of at least $10^5$ Cd/$m^2$ particularly of $10^9$ Cd/$m^2$ or more. Such punctiform light sources can only be obtained by way of laser light, for example, by using laser diodes.

As a result of the use of a punctiform light source, light distributions freely shaped by the optical device connected on the output side can be generated without a problem depending on the usage purpose of the lighting device. In particular, the shape of the optical device for generating a defined light distribution can thereby be determined in an algorithmically particularly simple manner, because the corresponding calculations can be based on an ideal punctiform light source. For calculating the shape of the optical device, particularly the so-called ITWM algorithm can be used which was developed by the Fraunhofer Institut für Techno- und Wirtschaftsmathematik.

In a further development of the lighting device according to the invention, at least one lighting unit generates a punctiform white light source during the operation. This variant will be used particularly when the lighting device is to take over the function of a vehicle headlight.

In a further particularly preferred embodiment of the invention, at least one lighting unit includes one or more laser diodes, particularly one or more monochromatic laser diodes. Nowadays, such laser diodes have radiances so that punctiform light sources can be generated that have a high luminance. In this case, the direct radiance of laser diodes is significantly higher than that of conventional LEDs. The radiance of a blue laser diode currently amounts to approximately $7\times10^5$ Watts/$cm^2$, while the radiance of an LED is only at 20 Watts/$cm^2$. Preferably, laser diodes with a luminous power of at least 1 Watt and particularly between 1.5 and 3.0 Watts or between 1.5 and 5 Watts are used in the lighting device according to the invention.

In a further preferred embodiment, at east one lighting unit has a converter which generates white light from the monochromatic light of the laser diode or laser diodes. In this case, the converter may be a phosphor conversion layer, on which the laser radiation of the laser diode or diodes is focused by use of optics (for example, a lens), whereby the punctiform white light source is generated on the phosphor conversion layer. Phosphor conversion layers for converting monochromatic light are known per se. For example, in the case of a blue laser diode with an emission wavelength of 450 nm, a phosphor conversion layer of Ce:YAG phosphor can be used for generating white light. For violet laser light with a wavelength of 405 nm, particularly a phosphor conversion layer of cerium-doped nitride phosphor or cerium-doped oxynitride phosphor is used.

For the conversion of monochromatic laser light to white light, as required, also an optical waveguide can be used, in which the monochromatic laser radiation of several monochromatic laser diodes may be appropriately combined for generating white light. The punctiform white light source may be formed at the exit surface of the optical waveguide. Likewise, optics ay be provided which appropriately focus the white light exiting from the optical waveguide for forming a punctiform light source.

In a further development of the invention, at least one lighting unit has a single monochromatic laser diode which represents a punctiform light source. This variant will be used particularly when a light of a certain color is to be generated by means of the lighting device.

Depending on the application case, the number of lighting units built into the lighting device may vary. In a preferred embodiment, the lighting device has 10 or less lighting units, particularly 3 to 6 lighting units.

Depending on the application case, the lighting device according to the invention can take over various functionalities. In one embodiment, the lighting device is a vehicle headlight. A vehicle headlight is distinguished in that it actively illuminates the environment of the vehicle. As required, the lighting device according to the invention may also be a vehicle signal light, which is distinguished in that it is used only for signaling to other traffic participants. In a preferred embodiment, the lighting device is further developed such that it can generate a low-beam light characteristic as a specified light distribution during operation. The low-beam light characteristic is known per se and is also specified in legal norms or standards (for example, SAE Standards). A low-beam light is distinguished in that the angular distribution of the radiated light has a horizontal light-dark cutoff in order not to blind oncoming traffic participants. As a rule, the angular distribution for illuminating the side of the road has a wider layout. A low-beam light further has a finite range, which is approximately at 65 m. By means of the lighting device according to the invention, it becomes possible to generate a light-dark cutoff with a high contrast for a low-beam light.

In a further embodiment of the invention, the lighting device s further developed such that, during operation, it can generate a high-beam light characteristic during operation as a specified light distribution. The light distribution of high-beam light is known per se and is distinguished in that the light has a greater range than low-beam light and is therefore concentrated in a smaller angular area around the vehicle longitudinal axis. In particular, no range limitation is specified for high-beam light. While the light values remain the same, a reduction of the light exit surface generally results in increase of glare values to which an oncoming mild be exposed. In the case of the high-beam light function, a size reduction and thus an increase of the glare values would not be a problem because the operation of high-beam light is, as a rule, intended only when there is no oncoming traffic. Nonetheless, by means of the lighting device according to the invention, as required, a glare-free high-beam light can also be implemented which has a light distribution with a vertical bright-dark cutoff with a contrast that is as high as possible with respect to the shadow area, in which the oncoming traffic is situated. In this case, the punctiform light source allows a significantly more precise implementation of the bright-dark cutoff and therefore reduces the glare effect also in this case.

In a further preferred embodiment, one or more lighting units include, in addition to the punctiform light source generated by laser light, one or more conventional LEDs or light emitting diodes, whose generated light is not laser light. In this case, the lighting device is further developed such that it can generate a light characteristic which is composed of the light of the LED or LEDs and the light of the punctiform light source. The punctiform light source preferably generates that fraction of the light characteristic which requires particularly high precision. In particular, the light characteristic may again be a high-beam light characteristic, the punctiform light source being responsible for that fraction of the high-beam characteristic which represents the central high-beam light spot for reaching the range of the high-beam light. The light distribution around this high-beam light spot with the lower range is, in this case, generated by the LED or LEDs. If necessary, there is also the possibility that the LED or LEDs and the punctiform light source are switched separately for generating certain light distributions.

The lighting device according to the invention may also be provided for generating other light distributions. The lighting device may particularly also take over the function of several different headlights or signal lights. In particular, the lighting device may also be a daytime running light, an indicator light, a backup light, a fog light, a turn signal light, a marker light, a taillight, a brake light and/or a dynamic spot light or the like.

In a further preferred embodiment, the lighting device is further developed such that, during operation, it can generate one or more specified structures, particularly one or more laminar shapes, one or more strips, one or more spots, one or more arrows, one or more symbols and/or one or more signs, as specified light distributions.

The optical device used in the lighting device according to the invention be further developed differently depending on its usage. This device preferably comprises at least one reflector and/or at least one lens.

As mentioned above, because of the use of punctiform light sources with a high luminance, the lighting device may have compact dimensions. In a preferred embodiment, the maximal dimension of the optical device in the top view (i.e. viewed in the main radiation direction with the highest intensity), is 50 mm or less, particularly 30 mm or less.

In addition to the above-described lighting device, the invention also includes a motor vehicle, which has one or more of the lighting devices according to the invention.

Other objects, advantages and novel features of the present invention will become apparent from the following detailed description of one or more preferred embodiments when considered in conjunction with the accompanying drawings.

BRIEF DESCRIPTION OF THE DRAWING

FIG. 1 is a schematic view of the construction of a lighting device for a motor vehicle according to an embodiment of the invention.

DETAILED DESCRIPTION OF THE DRAWING

In the following, the invention will be described on the basis of a lighting device in the form of a headlight of a motor vehicle, by which the environment is actively illuminated. The headlight preferably is the low-beam light or the high-beam light of the vehicle. Nevertheless, the lighting device according to the invention, as required, may also be implemented as a signal light in the motor vehicle, for example, as a brake light, an indicator light, or the like.

In the embodiment of the lighting device illustrated in FIG. 1, a plurality of lighting units is used, which have the reference number 1, only one of the lighting units being illustrated. The other (non-illustrated) lighting units can be arranged beside, above or below the illustrated lighting unit. The lighting unit includes a laser diode 2 with a laser beam exit surface 201, a front optical device 3 outlined as a lens, as well as a phosphor conversion layer 4. For the lighting unit 1, a freeform surface 6 is provided, which is designed as a mirroring reflector in the embodiment of FIG. 1. In this case, separate freeform surfaces may be provided for each lighting unit. Likewise, it is contemplated that a cohesive freeform surface is formed for the lighting units.

In the embodiment of the invention described here, the recognition is utilized that laser diodes have very high radiances, whereby, with a high light efficiency and precision, headlight distributions can be generated while the installation space of the headlight is simultaneously small. In the embodiment of FIG. 1, a blue laser diode with an emission wavelength of 450 nm is used, in which case the radiance is at approximately $7\times10^9$ Watts/cm$^2$. The laser diode represents an essentially punctiform light source, whose radiation characteristic A is schematically outlined. Punctiform means in this case, that the radiating surface is significantly smaller compared to the remaining components of the lighting device, so that it can be assumed in very good approximation that all light beams of the laser diode originate from one point.

In FIG. 1, the dimension L1 of the lighting unit 1 in the horizontal direction amounts to approximately 15 mm. The distance L2 between the layer 4 and the freeform surface 6 is significantly larger than the dimension L1 and is between 3 and 10 cm. In this case, it should be noted that the representation of FIG. 1 is not true to scale. In contrast, as an example, by means of the laser diode 2, in the top view along the optical axis O, a lighting area in the form of a rectangle is generated with edge lengths of 10 μm and 15 μm.

As indicated in FIG. 1, by way of the front-mounted optical device 3, the radiation of the laser diode 2 is focused on a phosphor conversion layer 4. Phosphor conversion layers are known per se from the state of the art and are used for generating white light from monochromatic laser light. When a blue laser diode is used, the material of the phosphor conversion layer preferably is Ce:YAG phosphor. Depending on the emission wavelength of the laser diode, other materials may also be used. For example, when a violet laser diode with an emission wavelength of 405 nm is used, in a preferred variant, a phosphor material made of cerium-doped nitrile or cerium-doped oxynitride is used.

Finally, by way of the phosphor conversion layer 4, a white light source 5 is generated, which again can be considered to be punctiform compared to the dimensions of the lighting device; i.e. in a very good approximation, the radiation originating from the light source 5 comes from a single point. The radiation characteristic of the punctiform light source 5 is schematically outlined in FIG. 1 and marked with the reference symbol A'. The dimension of the radiation area of the punctiform light source 5 in the top view along the optical axis O, as a result of scattering in the phosphor conversion material, is greater than the dimension of the radiation surface of the laser diode 2. Approximately, a radiation surface with edge lengths in the range of 500 μm is formed. Because of the very high luminance of the laser diode, a significantly higher luminance is obtained for the white light source 5 than can be reached in the case of conventional LEDs. In particular, the luminance is at approximately $2\times10^8$ Cd/m$^2$. As required, higher luminances in the range of $10^9$ Cd/m$^2$ and higher can also be obtained.

The light of the punctiform white light source 5 is finally incident on the reflector 6, which is arranged at a distance L2 from the white light source. The reflector surface 6 is only schematically outlined and has an asymmetrical structure. It is thereby expressed that, in combination with the laser lighting unit 1, arbitrary freeform surfaces can be used, by way of which, depending on the application case, the desired light distribution can be generated in the far field, for example, a low-beam light or a high-beam light. In this case, it is an advantage that, as a result of the high luminance of the punctiform white light source 5, very little installation space is required for generating a desired light distribution. Particularly when generating a high-beam light, the maximal dimension of the freeform surface 6 in the plane perpendicular to the optical axis O is only in the range of from 30 to 50 mm. Which is clearly less than in the case of conventional headlights. The use of the punctiform white light source has the additional advantage that the shape of the freeform surface 6 for generating the desired light distribution can be calculated in an algorithmically simple and highly precise manner, for example, by means of the above mentioned ITWM algorithm. It is therefore not necessary to always use a reflector as the freeform surface 6, but any other freeform optical device in the form of a lens or a combination of a lens and a reflector may also be used.

The above-explained embodiments of the invention have a number of advantages. By using laser light, a punctiform light source with a high luminance can be generated, whereby almost perfect freeform surfaces can be defined, by way of which a desired light distribution can be generated with high precision. In addition, by the use of laser light, an efficient lighting device can be created at lower electric power expenditures. Furthermore, the installation space of the lighting device can be reduced, which is advantageous particularly when generating vehicle high-beam light.

The lighting device according to the invention permits particularly a targeted illumination with a good imaging quality over broad field ranges. Furthermore, by means of the lighting device, a glare-free high-beam light with a vertical bright-dark cutoff with a very high contrast can be achieved, so that the shadow area, in which the oncoming traffic is situated, can be made as narrow as possible. In addition, high-quality low-beam light distributions can be achieved. Furthermore, different types of headlights or signal lights can be generated by use of the lighting device according to the invention. In particular, a marker light, a turn signal light, a fog light an indicator light, a brake light, a taillight, a backup light and a dynamic spot light or the like, can be created. The invention is not limited to generating white light, but, as required, the monochromatic light of the laser diode can also be used directly as a punctiform light source. This variant is used particularly in the case of signal lights, which usually emit light of a specified color (for example, red).

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A lighting device for a motor vehicle, comprising:

one or more laser lighting units, at least one of the one or more laser lighting units having:

a laser diode generating a first punctiform light source, wherein the first punctiform light source, in a top view along an optical axis, has a first radiation area, and a converter generating a second punctiform light source from the first punctiform light source, wherein the second punctiform light source, in the top view along the optical axis, has a second radiation area greater than the first radiation area; and an optical device configured and arranged with respect to the one or more laser lighting units such that a predetermined distribution of light from the second punctiform light source is generated after one or more of: (i) passing through and (ii) reflected by the optical device.

2. The lighting device according to claim 1, wherein the second punctiform light source, in the top view, has a maximum dimension of 500 μm or less.

3. The lighting device according to claim 1, wherein the second punctiform light source, in the top view, has a maximum dimension of 20 μm or less.

4. The lighting source according to claim 1, wherein the second punctiform light source, in the top view, has an emitting surface of 0.5 $mm^2$ or less.

5. The lighting source according to claim 1, wherein the second punctiform light source, in the top view, has an emitting surface of 0.0002 $mm^2$ or less.

6. The lighting device according to claim 1, wherein the second punctiform light source, in the top view, has an emitting surface with edges each having a length of 500 μm or less.

7. The lighting device according to claim 1, wherein the second punctiform light source, in the top view, has an emitting surface with edges each having a length of 20 μm or less.

8. The lighting device according to claim 1, wherein the second punctiform light source is configured to generated a light flux of 100 lm or more, a radiant power of 1 Watt or more, and a luminance of at least $10^5$ $Cd/m^2$ or more.

9. The lighting device according to claim 1, wherein the at least one of the one or more laser lighting units generates a punctiform white light source.

10. The lighting device according to claim 1, wherein the at least one of the one or more laser lighting units comprises a plurality of laser diodes.

11. The lighting device according to claim 1, wherein the at least one of the one or more laser lighting units comprises one or more monochromatic laser diodes.

12. The lighting device according to claim 9, wherein the converter is configured to generate the punctiform white light source from the laser diode that generates monochromatic laser light.

13. The lighting device according to claim 12, wherein the converter comprises a phosphor conversion layer on which the generated monochromatic laser light from the laser diode is focused via a further optical device, wherein the punctiform white light source is generated using the phosphor conversion layer.

14. The lighting device according to claim 12, wherein the converter comprises an optical waveguide, in which generated monochromatic laser light of a plurality of monochromatic laser diodes is combined for generating white light.

15. The light device according to claim 10, wherein at least one of the plurality of laser diodes is an individual monochromatic laser diode.

16. The lighting device according to claim 10, wherein the plurality of laser diodes have a luminance power of at least 1 Watt.

17. The lighting device according to claim 10, wherein the plurality of laser diodes have a luminance power of between 1.5 and 5 Watts.

18. The lighting device according to claim 1, wherein three to six lighting units are provided.

19. The lighting device according to claim 1, wherein the lighting device comprises a vehicle headlight or a signal light.

20. The lighting device according to claim 1, wherein the optical device comprises a reflector and/or a lens.

21. The lighting device according to claim 1, wherein the optical device, in the top view, has a maximum dimension of 50 mm or less.

* * * * *